US006439471B2

(12) United States Patent
Ehrlich et al.

(10) Patent No.: US 6,439,471 B2
(45) Date of Patent: Aug. 27, 2002

(54) CANDLE FOUNTAIN

(75) Inventors: Gernot Ehrlich, Lebanon, NJ (US); Chun Kuei Lin, Taipei (TW)

(73) Assignee: Peaktop Limited, Hong Kong (HK)

( * ) Notice: Subject to any disclaimer, the term of this patent is extended or adjusted under 35 U.S.C. 154(b) by 0 days.

(21) Appl. No.: 09/845,882

(22) Filed: Apr. 30, 2001

Related U.S. Application Data

(60) Provisional application No. 60/205,707, filed on May 19, 2000.

(51) Int. Cl.[7] ..... F21S 8/00; B05B 17/08

(52) U.S. Cl. ..... 239/18; 239/17; 239/20; 239/23; 239/211; 239/289; D23/201

(58) Field of Search ..... 239/16, 17, 18, 239/20, 21, 22, 23, 211, 289; 40/406; D23/201

(56) References Cited

U.S. PATENT DOCUMENTS 3,841,023 A * 10/1974 Carlyon, Jr. ..... 239/20
4,001,959 A 1/1977 Grendahl
4,705,216 A 11/1987 Kaffka et al.
5,637,361 A 6/1997 Scheurich
5,775,586 A 7/1998 Hamilton-Bruzzi
5,862,984 A 1/1999 Chang
5,934,557 A 8/1999 Shih
6,029,899 A 2/2000 Walker
6,149,070 A 11/2000 Hones
6,206,298 B1 3/2001 Ting
6,216,286 B1 * 4/2001 Zankow ..... 239/17

* cited by examiner

*Primary Examiner*—Steven J. Ganey
(74) *Attorney, Agent, or Firm*—Brooks & Kushman P.C.

(57) ABSTRACT

A candle fountain is provided which includes a base defining a reservoir therein which is adapted to hold a fluid, such as water. A pump having an inlet and an outlet is provided in communication with the base reservoir. A candle member is supported on the base, where the candle member includes a bore formed at least partially therethrough having an inlet and at least one outlet. The bore inlet is in fluid communication with the pump outlet such that fluid can be pumped from the base reservoir into the bore and out through the one or more bore outlets of the candle member. Advantageously, the candle member can be lit during operation of the candle fountain to provide additional sensory enjoyment.

43 Claims, 9 Drawing Sheets

CANDLE FOUNTAIN

CROSS-REFERENCE TO RELATED APPLICATIONS

This application claims the benefit of U.S. provisional application Serial No. 60/205,707 filed May 19, 2000.

BACKGROUND OF THE INVENTION

1. Field of the Invention

This invention relates to personal fountains.

2. Background Art

Many people enjoy fountains, finding the appearance and sound of flowing water soothing. In addition to typical outdoor fountains, fountains have been designed with a size and function appropriate for personal use in an interior home or office environment. The sound of naturally flowing water provides a desirable backdrop for sleep, relaxation, and concentration. Natural water sounds also increase concentration, acting as "white noise" which minimizes distractions and allows increased focus. Furthermore, flowing water fountains act as natural humidifiers by moisturizing the air.

Candles are similarly aesthetically pleasing, as they create a soothing glow. In addition to the light provided, candles can also emit scents which help a person to relax. The art of aromatherapy impacts both physical and mental well being, and is a natural remedy for stress relief.

Presently, fountains and candles exist separately which are intended for personal use. However, it would be desirable to provide a personal fountain which includes the aesthetic and aromatic benefits offered by candles.

SUMMARY OF THE INVENTION

Therefore, it is an object according to the present invention to provide a fountain which employs a candle member therein.

It is a further object according to the present invention to provide a candle fountain which is easy to assemble, use, and maintain.

Accordingly, a fountain is provided which includes a base defining a reservoir therein which is adapted to hold a fluid, such as water. A pump having an inlet and an outlet is provided in communication with the base reservoir. A candle member is supported on the base, where the candle member includes a bore formed at least partially therethrough having an inlet and at least one outlet. The bore inlet is in fluid communication with the pump outlet such that fluid can be pumped from the base reservoir into the bore and out through the one or more bore outlets of the candle member. Advantageously, the candle member can be lit during operation of the candle fountain to provide additional sensory enjoyment.

In a preferred embodiment, the fountain further includes a removable cover on which the candle member is supported, the cover having an upper surface, a lower surface, and aperture provided therein which is substantially aligned with the bore inlet. The cover includes at least one opening for allowing fluid to drain into the base reservoir. Preferably, the pump is disposed within the base, and the cover lower surface includes a tube extending downwardly from the aperture into the base which is adapted to mate with the pump outlet. Alternatively, the pump outlet can include a tube extending upwardly therefrom and through the cover aperture which is sized to be received in the bore inlet of the candle member. The pump can be electrically powered or constructed to be battery operated.

In further accordance with a preferred embodiment of the present invention, a sealing insert is disposed between the cover and the candle member. The sealing insert is constructed from an elastomeric material and includes an opening therein which is substantially aligned with the cover aperture and the bore inlet. The sealing insert also includes raised areas for enhancing contact with the candle member. The sealing insert is preferably disposed within a recess formed in an upper surface of the cover.

The base includes a floor member and a wall structure extending upwardly therefrom. In a preferred embodiment, the wall structure includes a plurality of flanges formed therein for supporting the cover, and the floor member includes a removable drain plug inserted therein.

Still further, a top surface of the candle member preferably includes at least one recess formed therein, and a nonconductive housing is preferably disposed within the recess. The one or more recesses can be sized to receive tea lights, or alternatively can be adapted to receive liquid wax therein. The candle member includes at least one wick, such that the candle member can be lit during operation of the fountain. The candle member can be constructed from wax, or alternatively from any non-wax material, thereby creating the visual impression of a candle. The candle member can also be constructed to provide aromatherapy.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
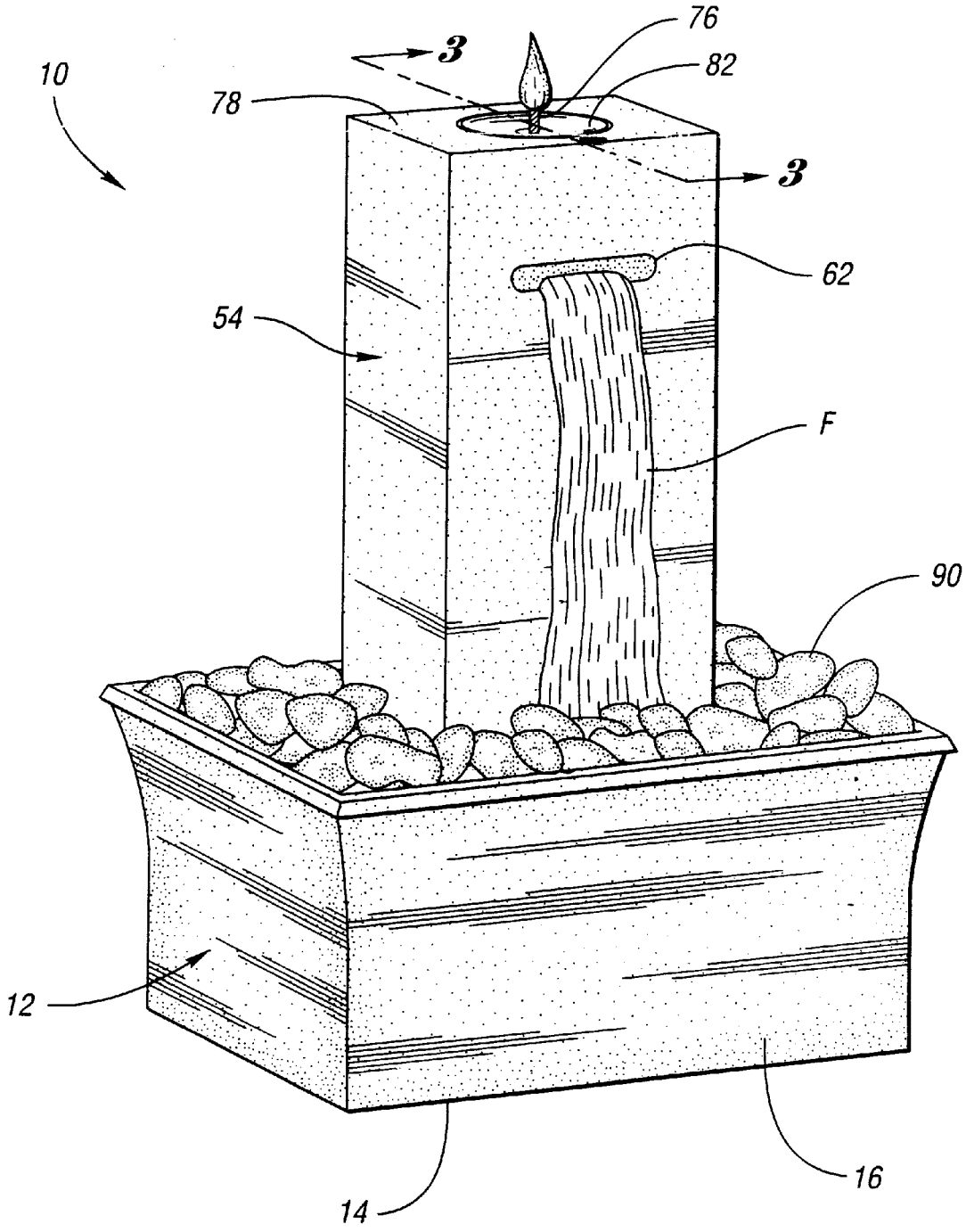
FIG. 1 is a perspective view of a candle fountain constructed according to the present invention, wherein the candle fountain is shown during operation.
Figure 2:
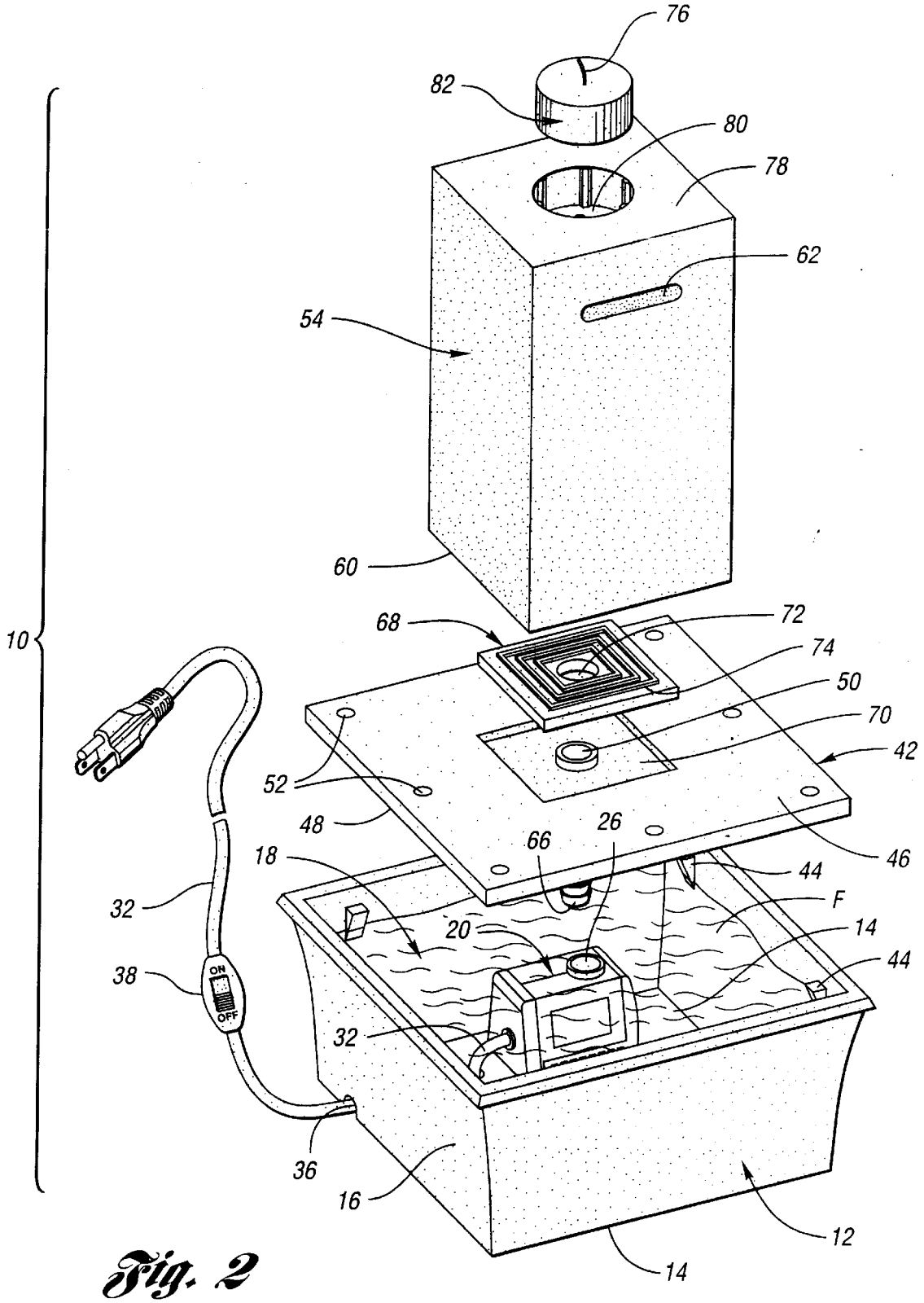
FIG. 2 is an exploded, perspective view of the candle fountain of FIG. 1.
Figure 3:
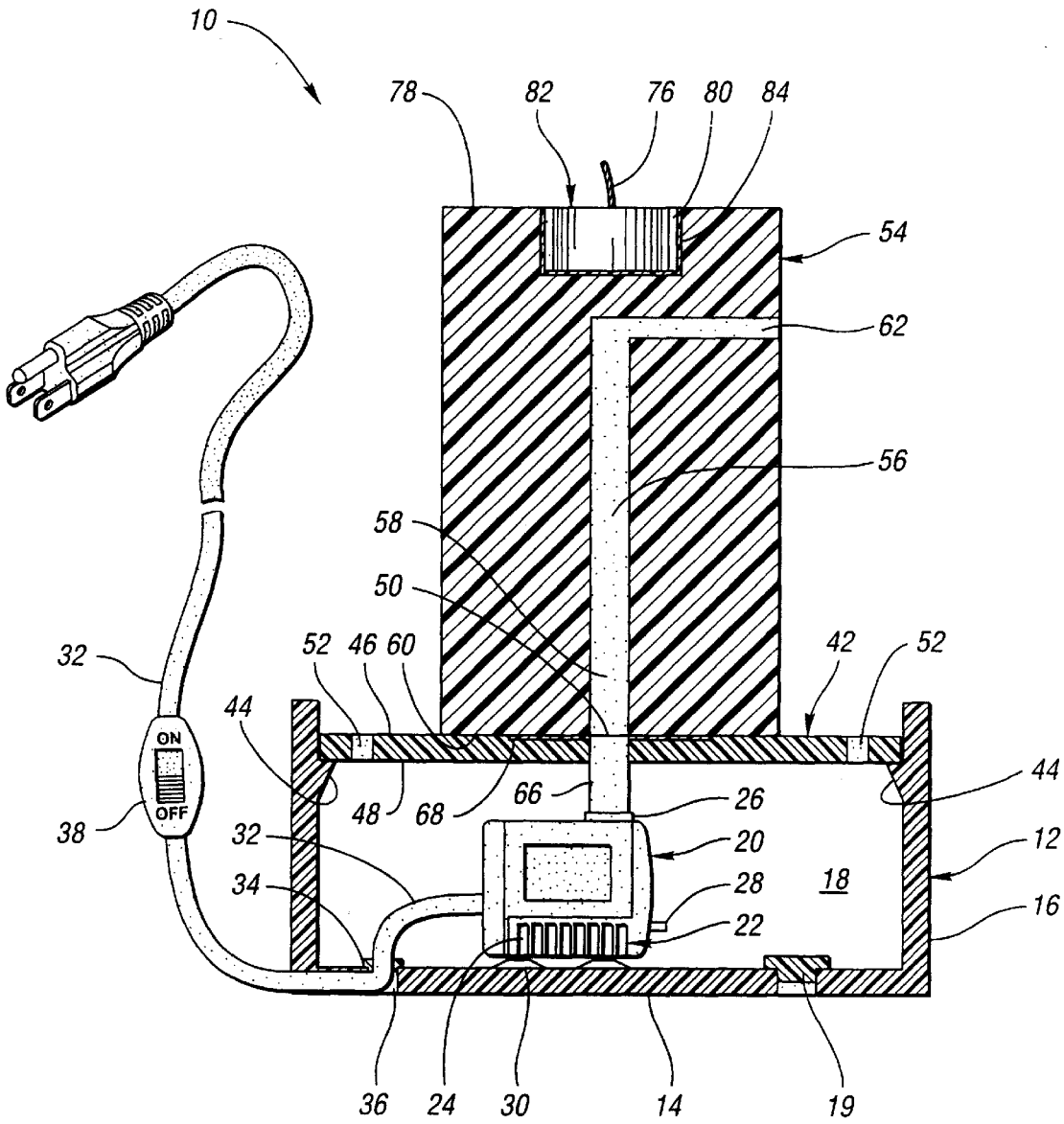
FIG. 3 is a cross-sectional view of the candle fountain of FIG. 1 taken along line 3—3.

Referring first to FIGS. 1–3, a candle fountain according to the present invention is illustrated and designated generally by reference numeral 10. Candle fountain 10 includes a base 12 that is constructed from any suitable material, preferably a nonflammable material such as ceramic, metal, nonflammable plastic, or the like. Base 12 includes a floor member 14 and a wall structure 16 extending upwardly therefrom. Base 12 can have any desired shape, such as the substantially flat-sided wall structure 16 shown or alternatively a more rounded wall structure for a bowl-like appearance. Although a compact, table top size of base 12 is shown and described herein, base 12 can be constructed to be any size suitable for the intended use of candle fountain 10.

Floor member 14 and wall structure 16 together define a reservoir 18 which is adapted to hold a desired fluid F therein. Candle fountain 10 will typically employ water, although oils and other suitable liquids are also fully contemplated. Referring to FIG. 3, floor member 14 can include a removable drain plug 19 inserted therein which can be used to aid replacement of the fluid F circulating through candle fountain 10.

Referring to FIGS. 2 and 3, a pump 20 is disposed inside base 12 and is configured to pump fluid F from reservoir 18. Pump 20 includes an inlet 22 that is preferably covered by a filter 24 to prevent larger particulate matter from entering pump 20. A motor (not shown) effects pumping of the fluid F from inlet 22 out through an outlet 26. Pump 20 further includes an output selector 28 (see FIG. 3) operable to vary the fluid flow rate as desired. Pump 20 also preferably includes suction cups 30 (see FIG. 3) affixed thereto for securing the position of pump 20 with respect to floor member 14. However, it is also contemplated that pump 20 could be positioned external to base 12, as long as pump 20 is provided in communication with base reservoir 18.

Pump 20 is preferably electrically powered, having a power cord 32 extending therefrom which preferably exits base 12 through a fluid tight orifice 34 in floor member 14. To allow base 12 to rest firmly on a support surface, floor member 14 can include a recessed tunnel 36 formed in an underside thereof which is sized to receive power cord 32 as it exits through orifice 34. Alternatively, power cord 32 could exit base 12 over a top surface of wall structure 16. Base 12 could also include feet (not shown) provided thereon to allow candle fountain 10 to sit steadily on a support surface and to absorb any vibration that might occur during the operation of pump 20. Power cord 32 can include an on/off switch 38 to facilitate operation of candle fountain 10. Candle fountain 10 according to the present invention could alternatively be configured to be battery operated.

With reference again to FIGS. 1–3, candle fountain 10 according to the present invention further includes a cover 42 which is disposed on wall structure 16 in a removable manner and preferably supported by a plurality of flanges 44. Cover 42 has an upper surface 46, a lower surface 48, and aperture 50 (best shown in FIG. 2) provided therein which is substantially aligned with pump outlet 26. Cover aperture 50 preferably extends slightly above upper surface 46 to facilitate the assembly of candle fountain 10 as described below. Cover 42 also includes at least one opening 52 for allowing fluid to drain into base reservoir 18. While cover 42 is shown herein to be substantially flat, cover 42 could alternatively be shaped to direct fluid F toward the one or more openings 52 and back into base reservoir 18.

A candle member 54 is supported on base 12, more particularly on cover upper surface 46, and functions as a fountain head for candle fountain 10. Candle member 54 can be affixed to cover 42 or base 12, but is preferably removably disposed thereon. Referring to the cross-sectional view of FIG. 3, candle member 54 includes a bore 56 extending at least partially therethrough. Bore 56 has an inlet 58 formed on a bottom surface 60 of candle member 54 which is in communication with pump outlet 26 for receiving fluid F from base reservoir 18. Bore 56 further includes at least one outlet 62 formed on any surface of candle member 54 through which fluid F can exit. Candle member 54 can be constructed of a wax material, such as paraffin, or can alternatively be made from any non-wax material, such as metal or plastic, for the reasons explained below. Candle member 54 can also be constructed to have any desired shape and thickness, as shown and described below with reference to FIGS. 7–9.

Figure 4:
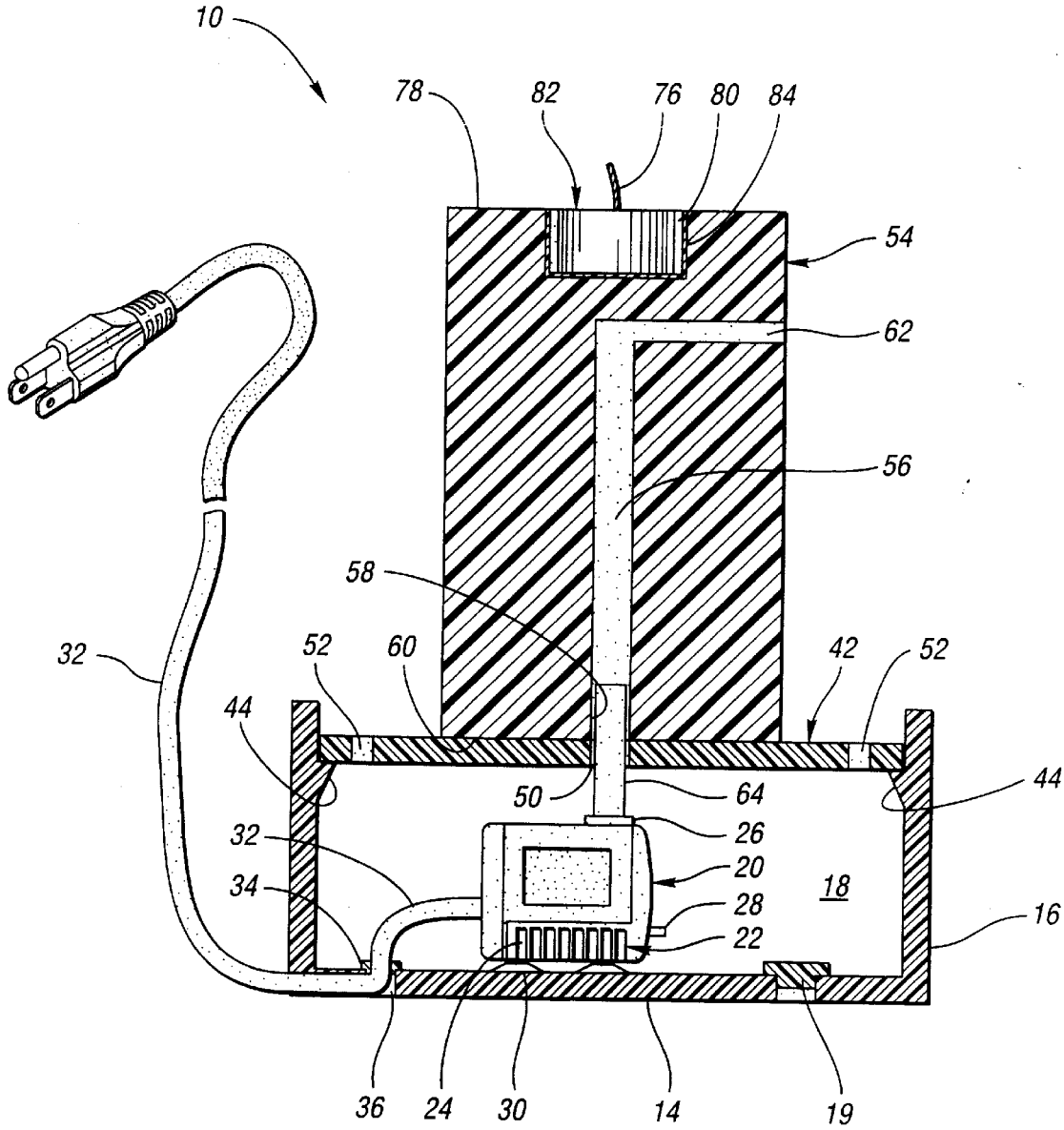
FIG. 4 is a cross-sectional view of the candle fountain similar to FIG. 3 showing an alternative embodiment of the pump outlet.

In order to communicate fluid F between base reservoir 18 and candle member 54, pump outlet 26 can include a tube 64 extending upwardly therefrom and through cover aperture 50 which is sized to be received in bore inlet 58 of candle member 54, as shown in the cross-sectional view of FIG. 4. In a preferred embodiment, however, no direct insertion into bore inlet 58 from pump outlet 26 is required. Rather, as shown in FIGS. 2 and 3, cover lower surface 48 includes a tube 66 extending downwardly from aperture 50 into base 12 which is adapted to mate with pump outlet 26, and a sealing insert 68 is disposed between cover 42 and candle member 54. Sealing insert 68 is preferably disposed within a recess 70 (see FIG. 2) formed in cover upper surface 46, and can be affixed thereto. Sealing insert 68 is constructed from an elastomeric material, such as rubber, and includes an opening 72 therein which is substantially aligned with cover aperture 50 and bore inlet 58. Sealing insert 68 also includes raised areas 74 (see FIG. 2) for enhancing contact with candle member bottom surface 60, thereby creating a good seal and acting to effectively suction candle member 54 to cover 42 such that fluid F can flow from pump outlet 26 into bore 56 without requiring the aid of tube 64 or the like. Therefore, use of sealing insert 68 further simplifies the design and assembly of candle fountain 10.

To assemble candle fountain 10 of the present invention and prepare for operation, base reservoir 18 is filled with fluid F and cover 42 is placed on base 12 such that tube 66 is received in pump outlet 26. Sealing insert 68 is placed within recess 70 on cover upper surface 46, and candle member 54 is positioned thereon such that bore inlet 58 is substantially aligned with cover aperture 50 and sealing insert opening 72. This alignment is aided by the extension of cover aperture 50 slightly above upper surface 46. To begin operation, pump 24 is actuated to direct fluid F from base reservoir 18 through pump outlet 26, tube 66, cover aperture 50 and sealing insert opening 72, and into bore inlet 58. Fluid F is forced through bore 56 and out of the one or more bore outlets 62. Fluid F then flows downwardly along candle member 54 to cover 42, and drains back into base reservoir 18 through the one or more openings 52 for recirculation.

Figure 5:
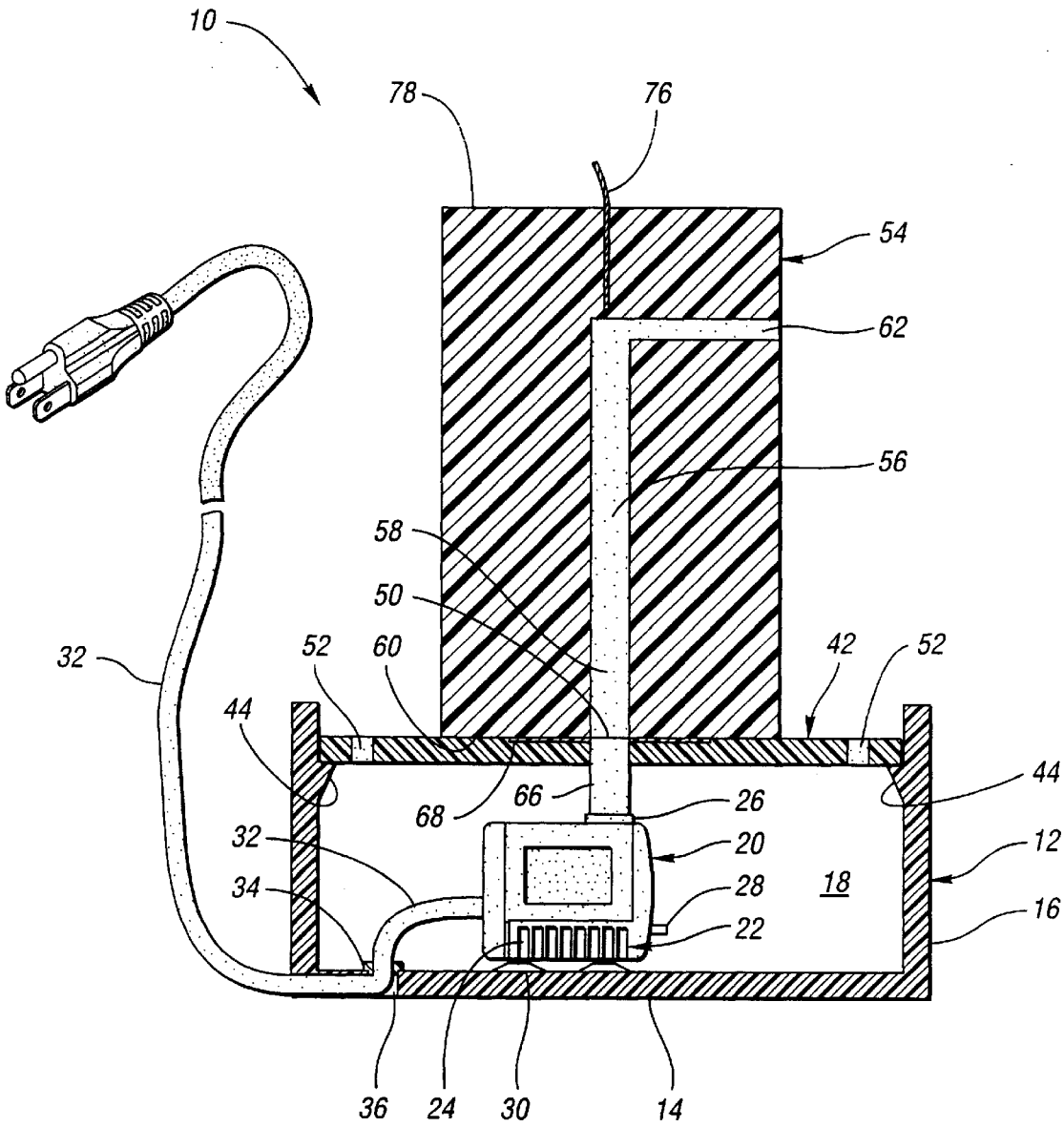
FIG. 5 is a cross-sectional view of the candle fountain similar to FIG. 3 showing an alternative embodiment of the candle member.

Advantageously, candle fountain 10 according to the present invention can also provide the illumination of candlelight. More specifically, candle member 54 includes at least one wick 76 which can be lit during operation of candle fountain 10. In an embodiment depicted in the cross-sectional view of FIG. 5, candle member 54 is constructed of a wax material and wick 76 is provided within candle member 54 itself, as in a conventional candle. Candle member 54 may be constructed to have a particular aroma for use in aromatherapy. As candle member 54 melts, a depression may form around each wick 76. However, fluid F flowing through bore 56 of candle member 54 will cool the wax of candle member 54, thereby limiting the size of any depression. Candle member 54 can easily be replaced if necessary.

In a preferred embodiment shown in FIGS. 1–3, a top surface 78 of candle member 54 includes at least one recess 80 formed therein which is sized to receive a small candle, or tea light 82. In this embodiment, candle member 54 need not be formed of a wax material, but still retains the visual impression of a conventional candle. If candle member 54 is formed of a wax material, a nonconductive housing 84, such as a plastic cup, is preferably disposed within recess 80 to prevent candle member 54 from melting. Housing 84 could alternatively be affixed directly to tea lights 82. Advantageously, lighting wicks 76 of tea lights 82 does not burn candle member 54, and tea lights 82 can be easily removed from recesses 80 and replaced. As described above, tea lights 82 can be employed which incorporate particular aromas for use in aromatherapy.

Figure 6:
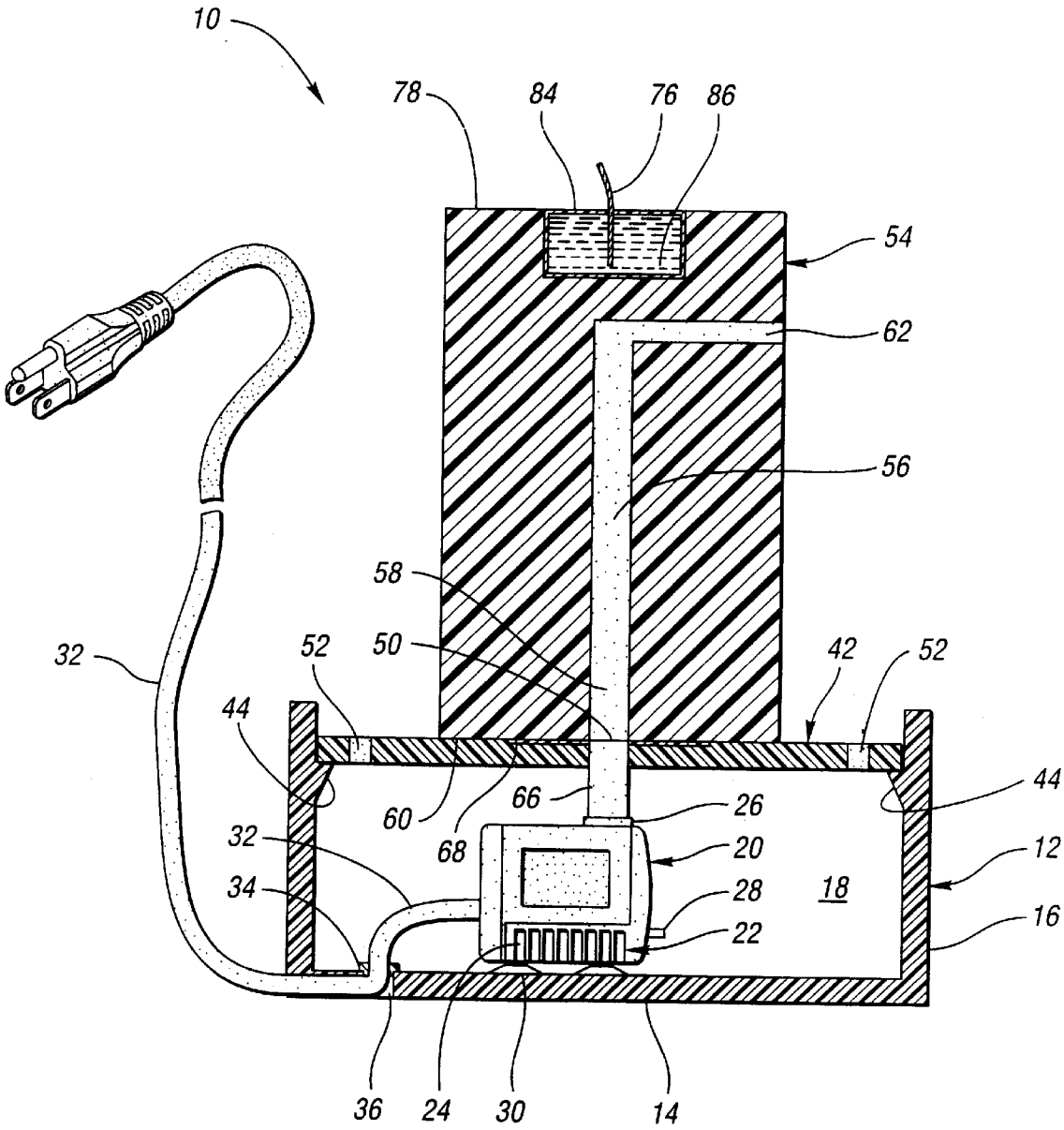
FIG. 6 is a cross-sectional view of the candle fountain similar to FIGS. 3 and 5 showing another alternative embodiment of the candle member.

Another alternative embodiment of candle member 54 is depicted in the cross-sectional view of FIG. 6. In this embodiment, recess 80 is adapted to receive liquid wax 86 therein. Again, candle member 54 need not be formed of a wax material but, if so, a nonconductive housing 84 is preferably disposed within recess 80 to prevent candle member 54 from melting. Therefore, a wick 76 associated with the liquid wax 86 can be lit without burning candle member 54 itself, and the liquid wax 86 can be easily drained from housing 84 and replaced as desired.

Figure 7:
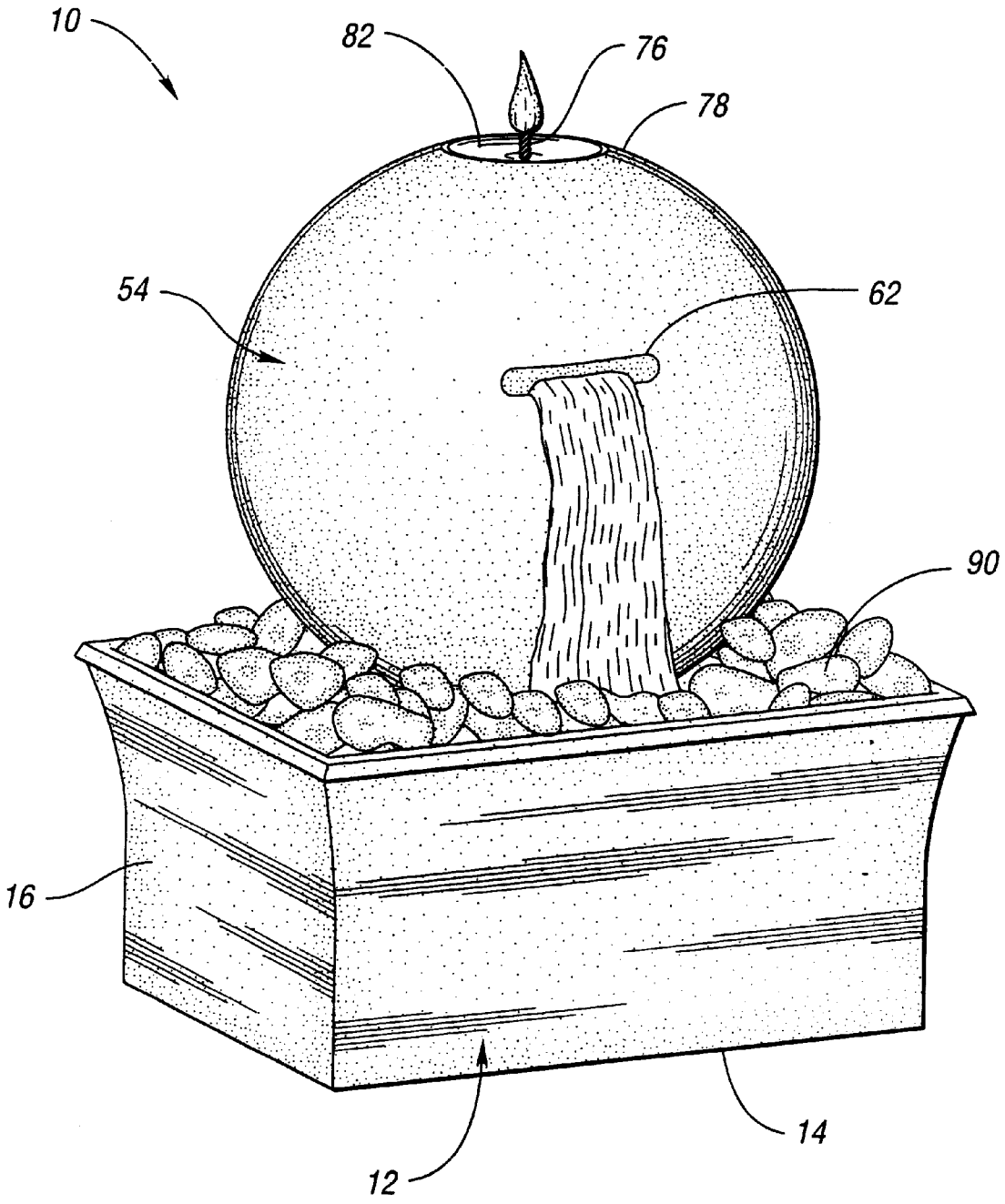
FIG. 7 is a perspective view of a second design for a candle fountain according to the present invention, wherein the candle fountain is shown during operation.
Figure 8:
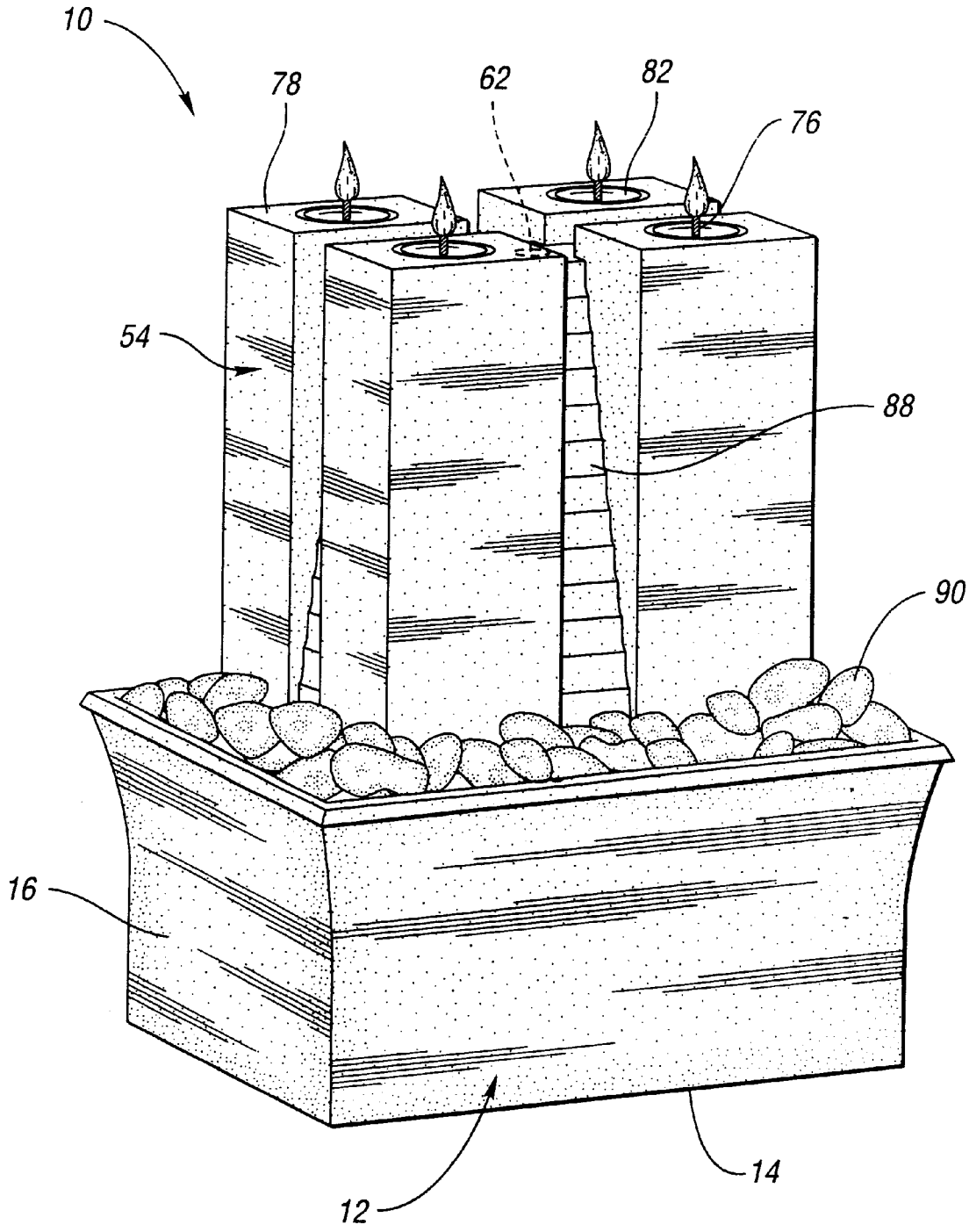
FIG. 8 is a perspective view of a third design for a candle fountain according to the present invention, wherein the candle fountain is shown during operation.
Figure 9:
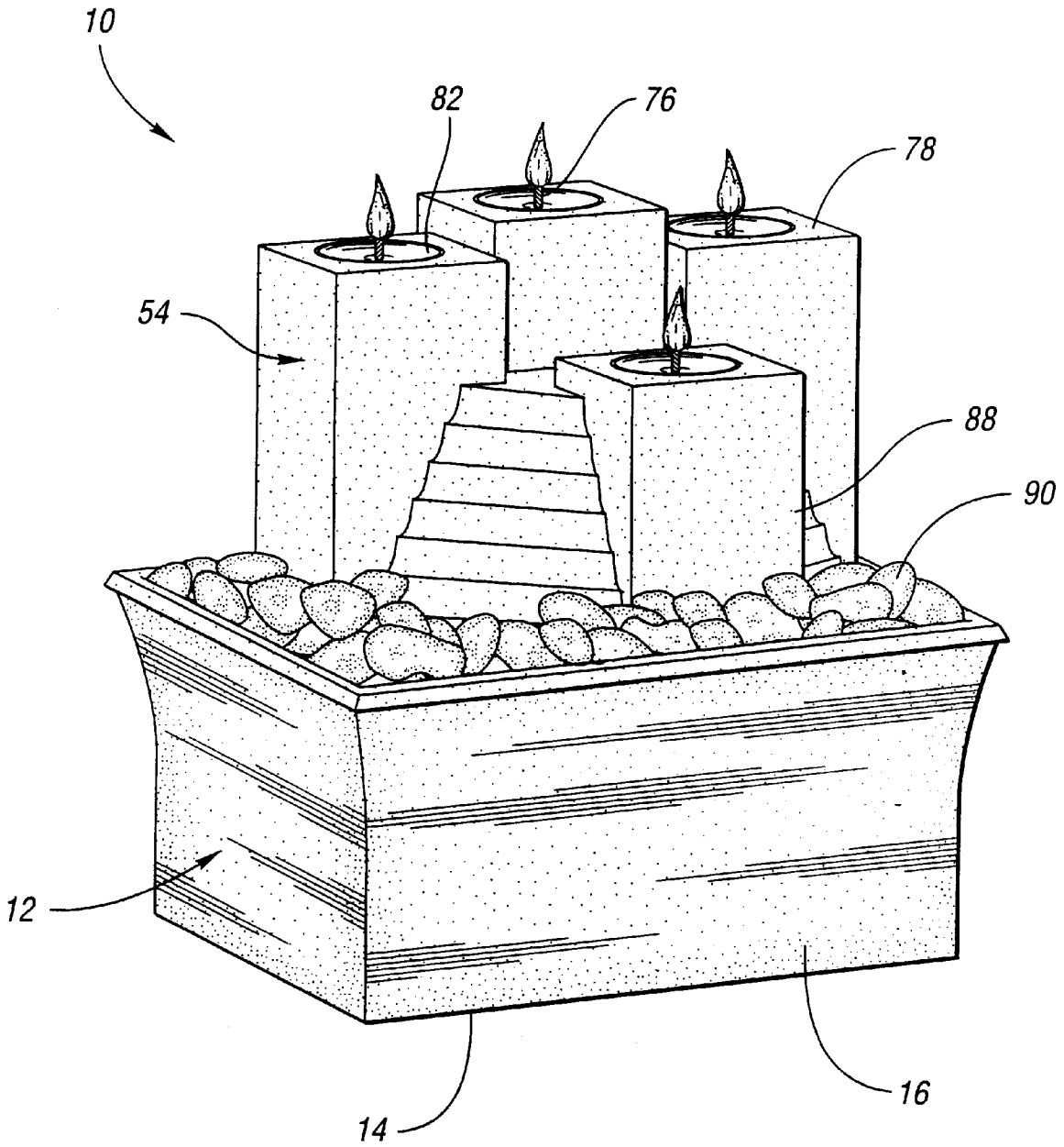
FIG. 9 is a perspective view of a fourth design for a candle fountain according to the present invention, wherein the candle fountain is shown during operation.

FIGS. 7–9 illustrate several additional designs of candle fountains 10 which are constructed according to the present invention. The illustrated embodiments show variations in the number of wicks 76, the placement of the bore outlets 62, as well as the inclusion of tier channels 88 over which the fluid F can flow toward base 12. As shown, decorative stones 90 may be placed onto cover 42 surrounding candle member 54 to further enhance the sound and appearance of candle fountain 10.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fountain, comprising:

a base defining a reservoir therein which is adapted to hold a fluid;

a pump in communication with the base reservoir, the pump having an inlet and an outlet; and a candle member supported on the base, the candle member including a bore formed at least partially therethrough having an inlet and at least one outlet, wherein the bore inlet is in fluid communication with the pump outlet such that fluid can be pumped from the base reservoir into the bore and out through the at least one bore outlet of the candle member.

2. The fountain according to claim 1, wherein the base includes a removable cover on which the candle member is supported, the cover having an upper surface, a lower surface, and aperture provided therein which is substantially aligned with the bore inlet.

3. The fountain according to claim 2, wherein the cover includes at least one opening for allowing fluid to drain into the base reservoir.

4. The fountain according to claim 2, wherein the pump is disposed within the base, and wherein the cover lower surface includes a tube extending downwardly from the aperture into the base which is adapted to mate with the pump outlet.

5. The fountain according to claim 1, wherein the pump outlet includes a tube extending therefrom which is sized to be received in the bore inlet of the candle member.

6. The fountain according to claim 1, further including a sealing insert disposed between the base and the candle member, the sealing insert including an opening provided therein which is substantially aligned with the bore inlet.

7. The fountain according to claim 6, wherein the sealing insert is constructed from an elastomeric material.

8. The fountain according to claim 1, wherein a top surface of the candle member includes at least one recess formed therein.

9. The fountain according to claim 8, further including a nonconductive housing disposed within the at least one recess.

10. The fountain according to claim 8, wherein the at least one recess is sized to receive a tea light therein.

11. The fountain according to claim 8, wherein the at least one recess is adapted to receive liquid wax therein.

12. The fountain according to claim 1, wherein the candle member includes at least one wick.

13. The fountain according to claim 1, wherein the candle member is constructed from a wax material.

14. The fountain according to claim 1, wherein the candle member is constructed from a non-wax material.

15. The fountain according to claim 1, wherein the candle member is constructed to provide aromatherapy.

16. The fountain according to claim 1, wherein the pump is electrically powered.

17. The fountain according to claim 1, wherein the pump is battery operated.

18. A fountain, comprising:

a base defining a reservoir therein which is adapted to hold a fluid, the base including a cover disposed thereon which has an aperture provided therein;

a pump disposed within the base, the pump having an inlet and an outlet;

a candle member supported on the cover, the candle member including a bore formed at least partially therethrough having an inlet and at least one outlet; and a sealing insert having an opening therein, the sealing insert disposed between the cover and the candle member such that the opening is substantially aligned with the cover aperture and the bore inlet, wherein the bore inlet is in fluid communication with the pump outlet such that fluid can be pumped from the base reservoir into the bore and out through the at least one bore outlet of the candle member.

19. The fountain according to claim 18, wherein a lower surface of the cover includes a tube extending downwardly from the aperture into the base which is adapted to mate with the pump outlet.

20. The fountain according to claim 18, wherein the cover includes a recess formed in an upper surface thereof which is sized to receive the sealing insert therein.

21. The fountain according to claim 18, wherein the sealing insert includes raised areas formed therein for enhancing contact with the candle member.

22. The fountain according to claim 18, wherein a top surface of the candle member includes at least one recess formed therein which is sized to receive a tea light.

23. The fountain according to claim 18, wherein a top surface of the candle member includes at least one recess formed therein which is adapted to receive liquid wax.

24. The fountain according to claim 18, wherein the base includes a wall structure having a plurality of flanges formed therein for supporting the cover.

25. The fountain according to claim 18, wherein the base includes a floor member having a removable drain plug inserted therein.

26. The fountain according to claim 18, wherein the sealing insert is constructed from an elastomeric material.

27. A candle fountain assembly, comprising:

a base including a floor member and a wall structure extending upwardly from the floor member, the base defining a reservoir therein which is adapted to hold a fluid;

a cover removably disposed on the wall structure, the cover having an upper surface, a lower surface, and an aperture provided therein;

a pump disposed within the base, the pump having an inlet and an outlet, wherein the pump outlet is in fluid communication with the cover aperture;

an elastomeric sealing insert having an opening formed therein, the sealing insert disposed on the cover upper surface such that the opening is substantially aligned with the cover aperture; and a candle member including a bore formed at least partially therethrough having an inlet and at least one outlet, the candle member being disposed on the cover upper surface over the sealing insert and with the bore inlet in fluid communication with the sealing insert opening, wherein operation of the pump directs fluid contained in the base reservoir from the pump outlet into the bore inlet and out through the at least one bore outlet of the candle member, and wherein the candle member can be lit during operation of the candle fountain.

28. A fountain, comprising:

a base defining a reservoir therein which is adapted to hold a fluid;

a pump in communication with the base reservoir, the pump having an inlet and an outlet; and a fountain head supported on the base, the fountain head at least partially constructed from a wax material and including a bore formed at least partially therethrough having an inlet and at least one outlet, wherein the bore inlet is in fluid communication with the pump outlet such that fluid can be pumped from the base reservoir into the bore and out through the at least one bore outlet of the fountain head, and wherein the fountain head creates the visual impression of a candle.

29. The fountain according to claim 28, wherein the base includes a removable cover on which the fountain head is supported, the cover having an upper surface, a lower surface, and aperture provided therein which is substantially aligned with the bore inlet.

30. The fountain according to claim 29, wherein the pump is disposed within the base, and wherein the cover lower surface includes a tube extending downwardly from the aperture into the base which is adapted to mate with the pump outlet.

31. The fountain according to claim 28, wherein the pump outlet includes a tube extending therefrom which is sized to be received in the bore inlet of the fountain head.

32. The fountain according to claim 28, further including a sealing insert disposed between the base and the fountain head, the sealing insert including an opening provided therein which is substantially aligned with the bore inlet.

33. The fountain according to claim 32, wherein the sealing insert is constructed from an elastomeric material.

34. The fountain according to claim 28, wherein a top surface of the fountain head includes at least one recess formed therein.

35. The fountain according to claim 34, further including a nonconductive housing disposed within the at least one recess.

36. The fountain according to claim 34, wherein the at least one recess is sized to receive a tea light therein.

37. The fountain according to claim 34, wherein the at least one recess is adapted to receive liquid wax therein.

38. The fountain according to claim 28, wherein the fountain head is at least partially constructed from a non-wax material.

39. A fountain, comprising:

a base defining a reservoir therein which is adapted to hold a fluid;

a pump in communication with the base reservoir, the pump having an inlet and an outlet;

a first candle member supported on the base, the first candle member including a bore formed at least partially therethrough having an inlet and at least one outlet, wherein the bore inlet is in fluid communication with the pump outlet such that fluid can be pumped from the base reservoir into the bore and out through the at least one bore outlet of the first candle member; and a second candle member associated with the first candle member, wherein the second candle member can be lit without lighting the first candle member.

40. The fountain according to claim 39, wherein the first candle member is constructed from a wax material.

41. The fountain according to claim 39, wherein the first candle member is constructed from a non-wax material.

42. The fountain according to claim 39, wherein the second candle member includes a tea light.

43. The fountain according to claim 39, wherein the second candle member includes liquid wax.

* * * * *